United States Patent [19]

Keeton

[11] Patent Number: 4,710,407

[45] Date of Patent: Dec. 1, 1987

[54] METHOD FOR PRESERVING FISHING NETS

[76] Inventor: Richard L. Keeton, P.O. Drawer 125, Taft, Tex. 78390-0125

[21] Appl. No.: 807,286

[22] Filed: Dec. 10, 1985

[51] Int. Cl.[4] ..... B05D 3/02

[52] U.S. Cl. ..... 427/389.9; 43/7; 87/8; 427/434.6; 428/255

[58] Field of Search ..... 43/7; 87/8; 57/250, 57/258, 259; 427/434.6, 389.9, 394; 428/198, 255, 288; 156/180

[56] References Cited

U.S. PATENT DOCUMENTS

| | | | |
|---|---|---|---|
| 3,123,496 | 3/1964 | Schlack et al. | 427/389.9 X |
| 4,116,743 | 9/1978 | Davis | 427/389.9 X |
| 4,199,489 | 4/1980 | Short | 528/58 X |
| 4,297,803 | 11/1981 | Saito | 427/389.9 X |
| 4,457,959 | 7/1984 | Dornheim et al. | 427/389.9 X |
| 4,483,889 | 11/1984 | Andersson | 427/389.9 |
| 4,594,286 | 6/1986 | McKinney et al. | 427/389.9 X |

OTHER PUBLICATIONS

Chemical Abstracts 95 (20) 170570q, (1981).

*Primary Examiner*—Thurman K. Page
*Attorney, Agent, or Firm*—Cox & Smith Inc.

[57] ABSTRACT

Method and composition for preserving fibrous materials. A urethane and thinning agent are mixed, and a fibrous material is contacted with the mixture and dried. An anti-oxidant, thinning agent or drier may optionally be mixed with the urethane and thinning agent. Extenders, plasticizers and ultraviolet light absorbers may also be used to advantage in some applications. The method and composition have particular application for use as a preservative for fishing and shrimping nets, uralkyd resins being the preferred urethane for this use.

10 Claims, No Drawings

METHOD FOR PRESERVING FISHING NETS

BACKGROUND OF THE INVENTION

The present invention relates to a method and composition for prolonging the usable life of fibrous materials. In more detail, the present invention relates to a composition for use as a preservative for such materials as ropes and fishing nets, including a urethane resin, a solvent, a drying agent, and, optionally, a coloring agent, antioxidant or antiskinning agent. Further, the present invention relates to a process for treating such fibrous materials to prolong their useful life which comprises applying the preservative to the fibrous material and subsequently drying the fibrous material.

Most fishing nets are made of various filamentous vegetable fibers, including cotton, linen, jute, or flax. Others are constructed from continuous synthetic resin fibers such as nylon, orlon, dacron, polyethylene, or polypropylene.

Numerous methods have been employed to prolong the usable life of fishing nets, including dipping the nets in paraffin or tar-based coatings, synthetic resins, a composition commonly known as "green dip", or a latex compound. U.S. Pat. No. 4,457,959 discloses a latex coating for fishing net, which is intended to minimize crimping and shrinking of nets. Those coating processes help to lock the knots of the net and decrease fraying of the filamentous strands forming the net. Locking the knots is desirable to prevent the deformation of the net when a heavy load is placed upon it. However, those coatings are limited in their ability to protect the fishing net to which they are applied from the elements to which those nets are exposed, including water and sunlight, because they either do not penetrate between the fibers of the fibrous material comprising the net, or penetrate minimally, and because they do not block the ultraviolet rays of the sun. So far as is known, no treatment exists to protect fishing nets from ultraviolet light, an important consideration due to the fact that fishing nets are alternately immersed in water and then dried in the sun. When the water is salt water, and when the net is comprised of a synthetic fiber, exposure to the sun is particularly damaging. Further, present methods afford protection to a net for a relatively limited period of time, and therefore, the treatment must be repeated at intervals as often as once a month during the useful life of a net.

Fishing nets have also been treated with chemical coatings intended to prevent the adhesion of algae and/or shell fish to the nets. For instance, U.S. Pat. No. 4,297,803 discloses the use of a coating of triisobutyltin hydroxide and an arylsulphonic acid derivative dissolved in an organic solvent to prevent the adhesion of algae and/or shellfish. However, this coating is of little or no use as a treatment for preserving the integrity of the nets because, so far as is known, it does not lock the knots and penetrates only minimally between the fibers. Nor is it effective at blocking even a portion of the sun's rays.

Another treatment which is directed to the same object, that of preventing or postponing deterioration of the net due to environmental factors, is disclosed in U.S. Pat. No. 2,590,586. That patent discloses a synthetic resin filament net, coated with either an ester-type resin derived from ethylene glycol and terephthalic acid, and maleic and aklyd resins, or a vinyl resin such as polyvinyl chloride, nylon polystyrene or acrylic resins such as polymethacrylate, melamine-formaldehyde resin, furan resin, or copolymers of those resins. The stated purposes of the net coating disclosed in that patent are to promote knot retention and to suppress the plastic "memory" of the resin core.

The netting formed according to that patent is believed to have certain disadvantages and limitations. For example, the preservative is applied to filaments formed from a synthetic resin, and the treatment process, involving heating, stretching, and drying, is performed prior to manufacture into a net. The net formed of the synthetic resin strands, and the method of producing the net, uses only polyester resins, and production of the net is resultantly complex and expensive. Further, so far as is known, the netting which results from the process disclosed in that patent is still vulnerable to sunlight.

There is, therefore, a need for a method or composition capable of extending the useful life of fibrous materials, in particular, fishing nets, which is capable of preventing deterioration of the net due to penetration of water between the net fibers, slipping of the knots of the net, and damage from exposure to the sun. Ideally, such a method should be one which may be performed only once or a very few times during the life of a net.

It is, therefore, an object of the present invention to provide a simpler method of treatment of any manufacture or composition of net, and a preservative of unique composition for such treatment, which is capable of prolonging the useful life of a fishing net or other fibrous material.

It is another object of the present invention to provide a composition and method which overcomes the problem of deterioration of nets and other fibrous materials due to alternating exposure to water and sunlight by rendering the net or fibrous material treated with that composition almost impervious to water absorption and exposure to sunlight.

It is another object of the present invention to provide a fishing net constructed of twisted nylon trifilament and treated with a preservative formulated according to the present invention which retains its knot integrity, knot spacing, and net rigidity without excessive bulk to such an extent that the life of a net in actual use is prolonged over that of any other treated or non-treated net.

Another object of the present invention is to provide a highly durable fishing net.

A further object of the present invention is to provide a composition for treating nets in general, such that a net so treated is strong, sun and water-resistant for a long period of time.

It is another object of the present invention to provide a new and useful fishing net in which the treatment modality is simple and need be performed only once prior to use of the net.

It is another object of the present invention to provide a method and composition useful for treatment of nets and rope materials such as nets and ropes for tennis courts, batting cages, hockey goal nets, animal trapping, flag poles and so on which increases the durability and weather resistance of those materials.

It is another object of the present invention to provide a method of preservating fibrous material comprising mixing a urethane resin with a thinning agent, contacting the fibrous material with that mixture, and thereafter, drying the fibrous material.

Other objects, features, and advantages of the invention, will become evident to those skilled in the art from the following detailed description.

SUMMARY OF THE INVENTION

Those objects are accomplished in the present invention by providing a method of preserving fibrous material comprising preparing a preservative mixture containing a urethane resin, a thinning agent, and, optionally, an anti-skinning agent, ultraviolet light absorber, anti-foaming agent, extender, plasticizer, and/or dye, contacting the fibrous material with that mixture, and drying the fibrous material. This method may be used as a treatment for a new or previously used net. The treatment process may be performed by dipping the fibrous material in the mixture and then drying it at ambient air temperature, or the mixture may be brushed onto fibrous materials such as a previously used net. The resultant fishing net or other fibrous material has properties of durability, water repellency, knot integrity, insensitivity to light exposure, and stability which are superior to the properties of fibrous materials treated by other known means.

DETAILED DESCRIPTION OF THE PREFERRED EMBODIMENT

According to the present invention, a composition is provided for preserving a fishing net or other fibrous material which comprises a urethane resin and a thinning agent. In a preferred embodiment, the urethane resin may be a polyurethane, a urethane, or a urethane alkyd. The term urethane alkyd refers to a urethane resin modified with a drying oil such as safflower, linseed, soybean, tung, or other oils. The thinning agent can be trichlorethane, methylene chloride, perchlorethylene, water, xylene, xylol, toluene, mineral spirits such as naphtha, or a mixture of those thinning agents with benzene. The composition of the present invention may also include a metallic drier such as cobalt or manganese drier, cerium, lead or chromium. The composition of the invention may in addition contain an anti-oxidant, anti-foaming or antiskinning agent.

The composition of the present invention may optionally include an extender. A suitable extender is an extender which is inert, durable, miscible, and abrasion resistant which is compatible with the urethane resin utilized. The extender can also be a filler having those same properties. Examples of suitable extenders include silicates, glass spheres, microscopic droplets of water permanently fixed in a plastic matrix, mineral rubber or any of the various proprietary extenders such as the silica-alumina ceramic spheres sold under the brand name ZEEOSPHERES (Zeelan Industries, Inc., St. Paul, Minn.)

The composition of the present invention may also optionally include an ultraviolet (UV) light absorber to help extend the life of the coated fibrous material by preventing fiber breakdown due to exposure to sunlight. A number of UV light absorbers are available which are compatible with the urethane resin of the composition of the present invention, the presently preferred UV light absorber being the various absorbers sold under the brand name SYNTASE (Neville-Synthese Organics, Inc., Pittsburgh, Pa.).

The anti-skinning agent may include any liquid antioxidant commonly used in paints and varnishes to inhibit formation of an oxidized film on the exposed surface in cans, pails, or other open containers. Antioxidants which may be used include substituted phenolic compounds such as butylated hydroxyanisole, di-tert-butyl-para-cresol, propyl gallate, aromatic amines such as di-beta-naphthyl-para-phenylenediamine and phenyl-beta-napththylamine, and may also optionally include citric and phosphoric acids.

Drying agents which may be suitable in the composition of the present invention may be any salt of metal with a valence of two or greater, including cobalt, manganese, cerium, lead, chromium, iron, nickel, uranium, and zinc, prepared as the linoleate, naphenate, or resinate of the metal.

The composition of the present invention may also optionally include a plasticizer to increase the flexibility and durability of the coated fibrous material. Plasticizers are particularly advantageous for use in a composition used in the coating of large nets because those nets must be folded for storage. Many fishing nets are over half a mile long, and must be folded for storage in a limited amount of space. For instance, the nets used in the menhaden fishing industry are so large that they must be able to be folded. The plasticizer can be any organic compound which is compatible with the other ingredients of the composition of the present invention and which bonds to the polymer molecule to aid in movement of the polymer chain segments. Suitable plasticizers include phthalate, adipate and sebacate esters, polyols such as ethylene glycol and its derivatives, and caster oil. Preferred plasticizers include butyl octyl phthalate, di(z-ethylhexyl) phthalate, dibutyl phthalate, discotyl phthalate, di-isodecyl phthalate, di-isononyl phthalate, tributyl phosphate, tri(butoxyethyl) phosphate, and tricresyl phosphate.

The amount and type of thinning agent added to the formulation can also be varied to increase the flexibility desired in the finished net. For example, adding organic oil solvents increases the flexibility of a coated net.

A net treated with the composition of the present invention is characterized by the permeation of the preservative within and between the net fibers, causing the net to be almost impervious to water and, if a UV light absorber is added, to the sun, resistant to the actions of bacteria, algae, and fungi, and resistant to fraying.

The composition of the invention is prepared by dissolving a drier in the solvent or thinner mixed with a polyurethane, a urethane or a urethane alkyd, in a container of sufficient size to hold the quantity of liquids to be combined. For instance, depending upon the formulation utilized 2½ to 5 gallons of the composition of the present invention are required to coat a 32 foot net. The optional dye, UV light absorber or extender is then added to the mixture and agitated or stirred to insure adequate mixing. The antioxident and drier are also added and mixed. This composition may be used to treat any fibrous material. An exemplary net thus treated, although still flexible, is generally stiffer than a non-treated net. The knot junctures of the net are stable, and cut ends of the fibrous material may come untwisted, but generally do not fray. Many nets and ropes are available commercially, and the construction of the net or rope per se is not critical since the method and composition of the present invention effectively prolong the useful life of all such materials.

The presently preferred method of application of the composition of the present invention is to dip the net in a container containing the preservative. The preservative may also be applied by means other than immersion, if desired, such as by brushing, rolling or spraying the preservative onto the net. Brushing, rolling or spraying the preservative onto the net is particularly advantageous when it is desired to apply the preservative to only a small portion of the net such as might be the case when a section of the net is replaced due to damage to the net. Spraying the preservative is particularly advantageous for rapid treatment such as is required for large-scale treatment in assembly-line fashion or with very large nets which cannot be immersed in the preservative in their entirety because of their bulk. Regardless of how the preservative is applied, it must be applied in sufficient quantity and for a sufficient period of time to insure complete penetration of the preservative into the fibrous material. For example, if the net is treated by immersion, it must be immersed in the preservative for a sufficient period of time to allow the preservative to penetrate within the net fibers.

The net is then removed from the preservative and dried by suspending it or draping it over a drying rack. It may be necessary to remove excess preservative from the net before drying or to hasten the drying process. Removal of excess preservative may be accomplished by shaking the net, running the coated net through two, opposed rollers, by running the coated net over a series of spaced rollers, or by a number of other methods known to those skilled in the art. The present invention may be better understood by reference to the following, non-limiting examples.

EXAMPLE 1

8 oz. (226.4 grams) Glidden Dramatone Tinting Color Black was dissolved in 1 gallon (4.55 liters) Glidden VMTP Naptha Thinner by slowly adding the thinner to the powdered tinting color in a vessel adequate to accommodate the mixture. After stirring the mixture for about 10 minutes to assure that the tinting color was completely dissolved four gallons (18.2 liters) of Spinkel Varithane Clear was added and mixed by stirring for about 5 minutes. Nets dipped in this mixture performed adequately but generally were not as durable as those prepared according to the method of Example 2, 3 and 11, below.

EXAMPLE 2

In an appropriate container, three gallons (13.65 liters) Cargill 4310 Resin was mixed together with two gallons (9.10 liters) Glidden 4537 Alkyd Speedenamel by constant agitation for about 20 minutes. To this mixture one gallon (4.55 liters) Exxon Varsol Thinner was then added and that mixture was stirred for about 5 minutes until combined. A net was immersed in this mixture for about 30 minutes. The net was then removed and air dried. Nets dipped in this formula showed no signs of wear and tear after 60 days of continual use in the Gulf of Mexico.

EXAMPLE 3

In an appropriate container, 8 oz. (226.4 grams) Glidden Dramatone Tint Orange, 4 oz. (113.2 grams) Pratt and Lambert Japan Drier, two quarts (2.275 liters) Shell Dri-Rex solvent, two quarts (2.275 liters) odorless mineral spirits, and five gallons (22.75 liters) Cargill 4310 resin were mixed by stirring for 20 minutes. A fishing net was immersed in that mixture for about 30 minutes. The fishing net was then suspended to permit the net to dry for about five hours. Nets treated with this formulation have been used for an entire season without appreciable deterioration.

EXAMPLE 4

In an appropriate container, 12 oz. (339.6 grams) Glidden Dramatone tint Orange was mixed with two gallons (9.10 liters) of Exxon Varsol thinner, and three gallons (13.65 liters) Cargill 4310 Resin. This mixture was stirred with a metal stirrer for about 20 minutes. Nets dipped in this formulation did not hold up as well as the nets treated as described in Example 3.

EXAMPLE 5

In this example, three gallons (13.65 liters) Briner's Iso-Clad Black was mixed with two gallons (9.10 liters) Briner's Xylol Thinner. The mixture was stirred for about 10 minutes. Nets were dipped twice into this mixture and hung to dry for about 6 hours on a drying rack.

EXAMPLE 6

A formulation prepared as described in Example 3, to which is added an extender, Zeeospheres 200 (Zeelan Industries, Inc., St. Paul, Minn.), in an amount 10% by volume (2.73 liters). The formulation is brushed onto a net suspended on a drying rack, and permitted to dry for about five hours.

EXAMPLE 7

Two gallons (9.10 liters) Briner's Iso-Clad Black, two gallons (9.10 liters) Briner's Iso-Clad Clear and one gallon (4.55 liters) Exxon Varsol were poured together into vessel. The mixture was stirred for about 15 minutes. Into this mixture, a net was immersed for about 30 minutes. The net was then removed from the mixture and suspended to dry for about 24 hours. Nets treated with this formula proved highly durable, but the color faded.

EXAMPLE 8

Three gallons (13.65 liters) Cargill 4310 Resin was mixed together with two gallons (9.10 liters) Glidden VMTP Naptha for 20 minutes by stirring. Into this product a fishing net was immersed for about 45 minutes. Nets treated in this formula were dipped twice to insure adequate preservation and require at least two weeks to dry.

EXAMPLE 9

A formulation prepared as described in example 3 is applied to the nets by spraying with conventional paint spraying equipment. The nets are then suspended on a drying rack for about 5 hours or until dry.

EXAMPLE 10

Two gallons (9.20 liters) Glidden 4537 Alkyd Industrial Enamel is mixed in an appropriate container with three gallons (13.65 liters) Glidden 5013 Clear Polyurethane. One gallon (4.55 liters) Glidden VMTP Naphtha Thinner is added and the mixture is stirred continuously for about 30 minutes. A net is immersed in this mixture for about 45 minutes, removed and suspended on a drying rack to dry for about 4 hours.

EXAMPLE 11

The composition in accordance with Example 11, below, is supplied to a rolling pan having a series of rollers mounted on axles such that a portion of the roller contacts the composition in the rolling pan. Ropes, nets and other fibrous materials are then pulled across the top of the rollers, causing the rollers to rotate and continuously apply the composition to the fibrous material.

EXAMPLE 11

Five gallons (22.75 liters) 4310 Cargill Resin is mixed in an appropriate container with one gallon (4.55 liters) Valley Dri-Rex naphthal solvent. Eight oz. (226.4 grams) six percent cobalt naphthanate drier and four oz. (113.29 grams) six percent manganese naphthanate drier are then added together with 1.5 lb. (681 grams) Exkin #2 (Tenneco) anti-skinning agent and tinting color as desired.

Into this composition, a net is immersed for thirty minutes, or for a sufficient time to insure that the solution has penetrated between the fibers of net. The formulation above presented is sufficient in amount to treat a thirty-two foot net, and nets treated with this composition show few signs of wear and tear even after 4 months of use.

EXAMPLE 12

In a presently preferred embodiment of the invention, the formulation is prepared by mixing in an appropriate container:

(a) five gallons (22.75 liters) 4310 Cargill resin
(b) one gallon (4.55 liters of blended solvent, containing
  (i) one part methylene chloride
  (ii) one part perchlorethylene
  (iii) one part 1:1:1 trichlorethane
  (iv) two parts Valley's Dri-Rex Naphthal
(c) 1.5 oz. 1/2% Neville's Syntase 1200 Ultraviolet light absorber (2-hydroxy-4-N-Dodecyloxybenzophenone)
(d) 0.5 gallon (2.275 liters) Neville's 40-150 Unichlor plasticizer
(e) 8 oz. (226.4 gm) six percent cobalt naphthanate drier
(f) 4 oz. (113.2 gm) six percent manganese drier
(g) 1.5 lb (681 gm) Exkin #2 (Tenneco) anti-skinning agent
(h) tinting color as desired.

The above ingredients were mixed for 20–30 minutes and a net immersed in the mixture for 30–45 minutes. The net was then suspended and air-dried.

The foregoing examples are provided by way of exemplification, and not limitation, of the present invention. Many alternatives, variations and modifications will be apparent to those skilled in the art who have the benefit of this disclosure. Those alternatives, variations and modifications are intended to fall within the spirit and scope of the following claims.

What is claimed is:

1. A process for treating a fishing net to increase durability which comprises:
  preparing a mixture of a urethane alkyd resin and a thinning agent;
  contacting a fishing net with said mixture; and
  drying said fishing net.

2. The process of claim 1 wherein said fishing net is dipped in said solution.

3. The process of claim 1 wherein said fishing net is dried at room temperature.

4. The process of claim 1 additionally comprising mixing said mixture with a drying agent.

5. The process of claim 1 additionally comprising mixing said mixture with an anti-skinning agent.

6. The process of claim 1 additionally comprising mixing said mixture with an extender.

7. The process of claim 1 additionally comprising mixing said mixture with a plasticizer.

8. The process of claim 1 additionally comprising mixing said mixture with an ultraviolet light absorber.

9. Fishing net produced in accordance with the process of claim 1.

10. A twined fibrous fishing nets produced in accordance with the process of claim 1.

* * * * *